US010000836B2

(12) United States Patent
Liang et al.

(10) Patent No.: US 10,000,836 B2
(45) Date of Patent: Jun. 19, 2018

(54) LOW-COST FINE-GRAIN WEAK-TEXTURE MAGNESIUM ALLOY SHEET AND METHOD OF MANUFACTURING THE SAME

(71) Applicant: Baoshan Iron & Steel Co., Ltd., Shanghai (CN)

(72) Inventors: Gaofei Liang, Shanghai (CN); Yongjie Zhang, Shanghai (CN); Qi Yang, Shanghai (CN); Gang Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 346 days.

(21) Appl. No.: 14/773,996

(22) PCT Filed: Mar. 13, 2014

(86) PCT No.: PCT/CN2014/073350
§ 371 (c)(1),
(2) Date: Sep. 9, 2015

(87) PCT Pub. No.: WO2014/180187
PCT Pub. Date: Nov. 13, 2014

(65) Prior Publication Data

US 2016/0024629 A1 Jan. 28, 2016

(30) Foreign Application Priority Data

May 7, 2013 (CN) ..... 2013 1 0163323

(51) Int. Cl.

| | |
|---|---|
| ***C22F 1/06*** | (2006.01) |
| ***C22C 23/04*** | (2006.01) |
| ***C22C 23/00*** | (2006.01) |
| ***B22D 21/00*** | (2006.01) |
| ***B22D 23/00*** | (2006.01) |

(52) U.S. Cl.
CPC ..... *C22F 1/06* (2013.01); *B22D 21/007* (2013.01); *B22D 23/00* (2013.01); *C22C 23/00* (2013.01); *C22C 23/04* (2013.01)

(58) Field of Classification Search
CPC ..... C22F 1/06; C22C 23/04
See application file for complete search history.

(56) References Cited

U.S. PATENT DOCUMENTS

| | | | |
|---|---|---|---|
| 3,320,055 A | 5/1967 | Foerster | |
| 2003/0000608 A1 | 2/2003 | Kabushiki et al. | |
| 2007/0102072 A1* | 5/2007 | Kawamura | C22C 23/04 148/666 |

FOREIGN PATENT DOCUMENTS

| | | |
|---|---|---|
| CN | 103255329 A | 8/2013 |
| JP | 6-235041 A | 8/1994 |
| JP | 2010013725 A | 1/2010 |
| JP | 2010111883 A | 5/2010 |
| WO | 2006003833 A1 | 12/2006 |
| WO | 2011065248 A1 | 3/2011 |
| WO | 2012070870 A2 | 5/2012 |
| WO | 2012115190 A1 | 8/2012 |
| WO | 2012115191 A | 8/2012 |

OTHER PUBLICATIONS

International Search Report issued in PCT/CN2014/073350, dated Jun. 13, 2014, 5 pages.

* cited by examiner

*Primary Examiner* — Jessee Roe
(74) *Attorney, Agent, or Firm* — Quarles & Brady LLP

(57) ABSTRACT

The present invention discloses a Mg—Ca—Zn—Zr magnesium alloy sheet, having the chemical compositions in weight percentage: Ca: 0.5~1.0%, Zn: 0.4~1.0%, Zr: 0.5~1.0%, the remainders being Mg and unavoidable impurities; wherein the magnesium alloy sheet has an average grain size of less than or equal to 10 μm, an interarea texture strength of less than or equal to 5, an interarea texture strength after annealing at 250~400° C. of less than or equal to 3, and a limiting drawing ratio at room temperature of more than AZ31; and the grain size thereof is remarkably less than that of AZ31B sheet produced in the same conditions, and the sheet texture is notably weakened. The magnesium alloy of the present invention has simple chemical compositions without noble alloy elements therein, thereby having a wide applicability and a low manufacturing cost, which can act as the sheets of interior door panels of cars, inner panels of engine lids, inner panels of trunk lids, internal decorative panels, vehicle bodies in the rail transits, and housings of 3C products, or the like.

5 Claims, 6 Drawing Sheets

LOW-COST FINE-GRAIN WEAK-TEXTURE MAGNESIUM ALLOY SHEET AND METHOD OF MANUFACTURING THE SAME

CROSS-REFERENCE TO RELATED APPLICATIONS

This application represents the national stage entry of PCT International Application No. PCT/CN2014/073350 filed Mar. 13, 2014 which claims priority of Chinese Patent Application No. 201310163323.8 filed May 7, 2013, the disclosures of which are incorporated by reference here in their entirety for all purposes.

TECHNICAL FIELD

The present invention relates to a low-cost magnesium alloy and a method of manufacturing the same, particularly, to a magnesium alloy sheet with fine grains, weak textures and good formability and a method of manufacturing the same. The obtained magnesium alloy sheet has an average grain size of less than or equal to 10 μm, an interarea texture strength of less than or equal to 5, an interarea texture strength after annealing at 250~400° C. of less than or equal to 3, and a formability higher than AZ31.

BACKGROUND

The magnesium crystal has a structure of close-packed hexagonal, and the Magnesium crystal sheet with strong textures exhibits mechanical properties of anisotropy and low formability. A fine grain structure and a disperse weak texture are the basic solution of improving the deformability under the conditions of medium-low temperatures and rapid strain rates, and of reducing the anisotropy of deformation, and at the same time, this micro-structure can improve the surface quality of the formed magnesium sheet. During the plastic deformation of magnesium alloy, the fine grain structure can restrict the occurrence of mechanical twin crystals effectively, alleviate moderately the demands of multi-crystal continuous deformation on the dislocation gliding coefficient number through grain boundary sliding, with reducing the over-stress concentration at the local grain boundary and accommodating the deforming defects; disperse weak sheet textures can increase the base surfaces and the cylinder surfaces to activate the sliding motion, improve the deformation hardening index and enable the deformation to occur evenly along the sheet surface, so as to enhance the formability.

The fine grains and disperse weak textures can be obtained by appropriate rolling technologies. Hitachi Metals carries out rolling at high temperature (about 500° C.), which starts the slipping of non-basal surfaces (Prismatic <a> and Pyramidal <c+a>) at the same time. The strength of the textures of magnesium sheet is 3.7, and the grains before and after annealing is kept substantially at about 6 μm, such that the sheet can be stamped at the room temperature.

US NanoMag Company produces AZ61 magnesium sheets by the way of rolling above the dynamic recrystallization, preheating the rollers up to 200° C., adopting the deforming mode of a large reduction rate in a single-pass (>40%), with the strength of the basal surface texture of the material being less than 3. The sheet texture after annealing is further weakened and diffused, with the micro-structure being isometric crystal; it should be noted that the particles of intermediate phase diffused by the AZ61 magnesium alloy matrix promote the weakening of the texture of the rolled sheet.

Japan Osaka University proposes the deforming mode of "high strain rate, large reduction rate per pass", with the strain rate of 180-2000/s and the reduction rate per pass of 50-60%. In the rolling deformation area, the heat from rolling deformation drives the rolling temperature to rise up obviously, so as to generate dynamic recrystallization. The materials consist primarily of isometric crystals of a dimension of 5 μm and the sheet texture becomes diffused.

The technical route of the magnesium alloy rolling process for obtaining the fine grains and the disperse weak textures, are briefly summarized as follows: 1) rolling at high temperature; 2) high strain rate, large reduction rate per pass; 3) shear rolling, 4) repeatedly bending and leveling after rolling.

An alloy design is another way to obtain magnesium sheets with fine grains and disperse weak textures, Korean patent KR2003044997 discloses a high formability magnesium alloy and a method of producing the same, which has the chemical compositions (in weight percentage): Zn: 0.5~5.0%, Y: 0.2-2.0%, Al: less than or equal to 2.5%, Mn: less than or equal to 0.5%, Ti: less than or equal to 0.2%, Zr: less than or equal to 0.5%, Cd: less than or equal to 0.5%, Tl: less than or equal to 0.5%, Bi: less than or equal to 0.5%, Pb: less than or equal to 0.5%, Ca: less than or equal to 0.3%, Sr: less than or equal to 0.3%, Sn: less than or equal to 0.5%, Li: less than or equal to 0.5%, Si: less than or equal to 0.5%; the technical processes thereof are: 1) heating the magnesium ingot up to 250~450° C. for a heating time of 2 min/mm; 2) rolling at a temperature of 200~450° C., with the first-pass reduction rate being less than or equal to 20%, and the other-pass reduction rate being 10~35%; 3) annealing at the temperature of 180~350° C.

China patent CN101985714 discloses a high-plasticity magnesium alloy and a method of preparing the same, which has the chemical compositions (in weight percentage): Al: 0.1~6.0%, Sn: 0.1-3.0%, Mn: 0.01-2.0%, Sr: 0.01-2.0%, and which can be used for producing sheets and sections.

Japan patent JP2012122102A discloses a high-formability magnesium alloy which has the chemical compositions (in weight percentage): Zn: 2.61-6.0%, Ca: 0.01-0.9%, and a trace of Sr and Zr, wherein preferably the total contents of Ca and Sr is between 0.01~1.5%, and the total contents of Zr and Mn is between 0.01-0.7%; the produced magnesium sheet has the room temperature properties: the yield strength of 90 Mpa, and the Ericksen value of more than or equal to 7.0.

WO2010110505 discloses a method of manufacturing Mg—Zn-based magnesium alloy with high-speed formability at room temperature, which has the chemical compositions (in weight percentage): Zn: less than or equal to 3.5%, and one or more elements of Fe, Sc, Ca, Ag, Ti, Zr, Mn, Si, Ni, Sr, Ni, Sr, Cu, Al, Sn; and which material presents excellent formability through lowering the recovery and recrystallization temperatures and activating the slippage of the low-temperature non-basal surfaces.

Recently, Korean patent KR20120049686 discloses a high-strength high-formability magnesium sheet and a method of producing the same, which has the chemical compositions (in weight percentage): Zn: 5-10%, Ag: 0.1-3.0%, Ca: 0.1-3.0%, Zr: 0.1-3.0%, Mn: 0.1-1.0%; wherein fine structures can be obtained via the pretreatment before rolling and TMP technology, and the limit forming height may be beyond 10 mm.

Rare earth elements can weaken the texture of the magnesium alloy sheet. For instance, in the patent WO2010041791, Y elements are added into the Mg—Zn-based magnesium alloy to generate the effects of precipitation strengthening and the twin-roller continuous casting and rolling and TMP technology are employed for refine grains. The obtained material has the advantages of high strength, plasticity, and low anisotropy at the room temperature, thereby presenting high formability.

Additionally, the textures of the rare earth magnesium alloy sheet such as ZE10 (Mg1.3Zn0.1Ce), ZEK100 (Mg1.3Zn0.2Ce0.1La0.5Zr), ZW41 (Mg4.0Zn0.7Y), ZG11 (Mg1.2Zn0.8Gd), ZG21 (Mg2.3Zn0.7Gd), are weakened obviously. Taking ZG11 as an example, it has a grain size of 12-15 μm, an uniform elongation rate of 15%, a total elongation rate of up to 36% and Lankford value of 1 (far lower than AZ31:3), with reference to H Yan etc., *Mater. Sci. Eng. A,* 2010, 527: 3317-22.

Although the rare earth elements work well in weakening the texture of magnesium sheet, but taking factors such as the cost into account, it is difficult for rare earth magnesium alloy sheets to be applied into automobiles. For the fields of automobiles and rail transits, it is required that the alloy design and production processes be simple and effective, and the performances be "proper" rather than "excellent", with a balance among the lightweight, performances and cost, which is totally different from the field of military, aerospace, etc.

SUMMARY

The objective of the present invention is to provide an innovative low-cost fine-grain weak-texture magnesium alloy sheet and a method of manufacturing the same, wherein the compositions design of the magnesium alloy is simple, and the sheet has an average grain size of less than or equal to 10 μm, an interarea texture strength of less than or equal to 5, an interarea texture strength after annealing at 250~400° C. of less than or equal to 3, and a limit drawing ratio at the room temperature of more than AZ31, with good formability and possibility to apply to the fields of automobiles, rail transits, etc.

To achieve the above-mentioned objective, the present invention takes the following technical solution:

a Mg—Ca—Zn—Zr magnesium alloy sheet, which has the chemical compositions in weight percentage: Ca: 0.5~1.0%, Zn: 0.4~1.0%, Zr: 0.5~1.0%, the remainders being Mg and unavoidable impurities; the magnesium alloy sheet has an average grain size of less than or equal to 10 μm, an interarea texture strength of less than or equal to 5, an interarea texture strength after annealing at 250~400° C. of less than or equal to 3, and a limit drawing ratio at the room temperature of more than AZ31.

The Mg—Ca—Zn—Zr magnesium alloy in the present invention has only Ca, Zn and Zr therein, the total content of which is lower than 3.0%, and has no noble elements like rare earth.

In the design of the chemical compositions of the present invention:

Ca: Ca is used for improving the metallurgical quality of magnesium alloy, alleviating the oxidation in the heat treatment process of the melt and the cast before casting, and refining grains so as to improve the crimping resistance and rollability of the sheet. The present invention uses primarily the features of weakening the sheet texture and age hardening of Ca, to enhance the strength of the magnesium alloy sheet and improve the formability at room temperature. Taking the smelting process and the solid solubility of Ca in magnesium alloy into account, the content of Ca is selected as 0.5-1.0%.

Zn: Zn is used for solid solution strengthening, and age strengthening, and combines with Zr to present the deposit hardening effect; besides, Zn can reduce the corrosion rate of magnesium alloy. Ca can weaken and diffuse the sheet texture remarkably, but also reduce remarkably the anti-corrosion performance of magnesium alloy. Upon the addition of Zn, the anti-corrosion performance thereof is improved, and the comprehensive corrosion resistance of magnesium alloy may be optimized by adjusting the ratio of Zn/Ca; however, when the content of Zn is too high, the hot shortness of the magnesium alloy increases notably. Taking these factors into consideration, the content of Zn is selected as 0.4-1.0%.

Zr: Zr has a strong effect of grain refinement, and the effect is apparent in the magnesium alloy containing Zn; at the same time, it improves the corrosion resistance of the material and reduces the susceptibility of strain corrosion. It is generally considered that only solid solution Zr can refine grains. Considering the solid solubility and the smelting, the content of Zr is selected as 0.5-1.0%.

The method of manufacturing Mg—Ca—Zn—Zr magnesium alloy sheet (with a thickness of 0.3~4 mm), can be implemented by performing the hot rolling cogging, twin-roller continuous casting and rolling, or extrusion cogging, on various raw sheets and assisting with the warm-rolling process, and in particular, it is any one of the following methods (1)~(3):

(1) a method of manufacturing Mg—Ca—Zn—Zr magnesium alloy sheet (with a thickness of 0.3~4 mm), including the following stages:

heating the casting blank of Mg—Ca—Zn—Zr magnesium alloy with the aforementioned composition proportions up to a temperature of 370~500° C., and carrying out solid solution, then hot rolling and warm rolling, so as to obtain the Mg—Ca—Zn—Zr magnesium alloy sheet with a thickness of 0.3~4 mm; wherein the heat preservation time in the solid solution is 0.5~1 min/mm; when in the hot rolling, the roller surfaces are preheated at 150~350° C., the blooming temperature is 450~500° C., the finish rolling temperature is 300~350° C., and the reduction rate in a single pass is 20~50%; when in the warm rolling, the roller surfaces are preheated up to 150~350° C., the magnesium alloy sheet is online concurrent heated, the rolling temperature is 150~350° C., and the reduction rate in a single pass is 20~40%.

In the hot rolling process of the present invention, it is preferable to adopt a large reduction rate per pass, so as to finish the rolling in a cycle without a secondary heating. Comparing to the typical commercial AZ31 magnesium alloy, the magnesium alloy of the present invention has a high melting point and contains a certain amount of Zr element, with a high casting blank heating temperature selected as 370~500° C. and a necessary long heat preservation time selected as 0.5~1 min/mm; correspondingly, the rolling is performed under a high temperature, and the blooming temperature is selected as 450~500° C. and finish rolling temperature as 300~350° C.; the hot rolling needs to finished in a heating cycle, and the single pass reduction rate is controlled between 20~50%.

In the warm rolling process of the present invention, the magnesium alloy sheet needs to be online concurrent heated. Owing to the fine grains and weak texture of the Mg—Ca—Zn—Zr magnesium alloy hot rolling sheet, it presents excellent rollability, and a warm rolling window is bigger than that of AZ magnesium alloy. It is preferred that the roller surfaces are preheated at 150~300° C., the rolling temperature is 150~350° C., and the reduction rate in a single pass is 20~40%.

(2) a method of manufacturing Mg—Ca—Zn—Zr magnesium alloy sheet (with a thickness of 0.3~4 mm), including the following stages:

pouring the magnesium alloy melt with the aforementioned composition proportions into a twin-roller continuous cast-rolling mill for cast-rolling, so as to obtain the cast-rolling coil; warm rolling the cast-rolling coil after solid solution or directly warm rolling the cast-rolling coil, so as to obtain the Mg—Ca—Zn—Zr magnesium alloy sheet with a thickness of 0.3~4 mm; wherein upon casting and rolling with the twin-roller continuous cast-rolling mill, the rotation linear velocity of the rollers is 5-10 m/min, the roller gap is 4-8 mm, the roller surfaces are lubricated by graphite, and the gases $N_2$ and $CO_2$ pass through the smelter and casting system and $SO_2$ passes through the pouring exit for protection; the temperature of the solid solution is 370~500° C., and the heat preservation time thereof is 0.5~1 min/mm; when in the warm rolling, the roller surfaces are preheated up to 180~300° C., the magnesium alloy sheet is online concurrent heated, the rolling temperature is 180~300° C., and the reduction rate in a single pass is 20~40%.

Comparing to the hot rolling cogging technology, the twin-roller continuous cast-rolling magnesium alloy sheet cannot have the scales milled, and due to containing the elements such as Ca, Al, in the Mg—Ca—Zn—Zr magnesium alloy, the pouring exit is protected by passing $SO_2$ rather than $SF_6$ gas, in order to prevent from forming the harmful inclusions like CaF; at the same time, the whole smelting and casting system is passed by $N_2$ and $CO_2$ in order to prevent from forming the harmful inclusions like AlN. The warm rolling properties of the twin-roller continuous cast-rolling magnesium alloy sheet is lower than that in the hot rolling cogging, and for guaranteeing the material yield rate, the roller surfaces are preheated up to 180~300° C., the rolling temperature is 180~300° C., and the reduction rate in a single pass is 20~40%.

(3) a method of manufacturing Mg—Ca—Zn—Zr magnesium alloy sheet (with a thickness of 2~4 mm), including the following stages:

heating the casting blank of magnesium alloy with the aforementioned composition proportions up to a temperature of 370~500° C., and carrying out solid solution, then performing horizontal extrusion, so as to obtain the Mg—Ca—Zn—Zr magnesium alloy sheet with a thickness of 2~4 mm, or performing horizontal extrusion and subsequently warm rolling, so as to obtain the Mg—Ca—Zn—Zr magnesium alloy sheet with a thickness of 0.3~2 mm; wherein the heat preservation time in the solid solution is 0.5~1 min/mm; when in the horizontal extrusion, the extrusion container and the die (die cushion) are preheated up to 400~500° C., the extrusion temperature is 350~500° C., and the extrusion rate is 2~10 m/min; when in the warm rolling, the roller surfaces are preheated up to 150~300° C., the magnesium alloy sheet is online concurrent heated, the rolling temperature is 150~300° C., and the reduction rate in a single pass is 30~50%.

As mentioned above, the Mg—Ca—Zn—Zr magnesium alloy of the present invention has a high melting point, and during the extrusion, needs a relatively high solid solution temperature and an extrusion temperature, and it is necessary to preheat the extrusion container and the die (die cushion) up to 400~500° C. and the extrusion is performed under a high rate, which can be selected as 2~10 m/min. The extruded magnesium alloy sheet has a superior rollability, with a possible selected large reduction rate in a singe pass: 30~50%. For the sheet with a thickness of 0.3~2 mm, the warm rolling process is adopted, the roller surfaces are preheated up to 150~300° C., the magnesium alloy sheet is online concurrent heated, the rolling temperature is 150~300° C., and the reduction rate in a single pass is 30~50%.

Further, in order to improve the quality of magnesium alloy sheet, especially the quality of warm rolling magnesium alloy sheet, the subsequent treatment further includes the cold rolling stage, with the cold rolling reduction rate being 10~20%, and the thickness of the finished sheet being further declined to about 0.3 mm.

Further, in order to improve the formability of the magnesium alloy sheet, it further includes an annealing treatment and/or an aging treatment; wherein, the annealing temperature is 250~400° C., and the aging temperature is 150~200° C. The annealing process enables to further weaken the texture so as to improve the formability of the material, therefore, the annealing temperature is selected as 250~400° C. Comparing to AZ31, the Mg—Ca—Zn—Zr magnesium alloy of the present invention has a certain effect of age hardening, and it plays a important role to control the aging temperature, hence the aging temperature is selected as 150~200° C.

The present invention has the following advantages over the prior art:

The magnesium alloy sheet obtained by the present invention has an average grain size of less than or equal to 10 μm, an interarea texture strength of less than or equal to 5, an interarea texture strength after annealing of less than or equal to 3; the grain size is remarkably less than that of AZ31B produced in the same conditions and the sheet texture is weakened apparently. Additionally, the hot subsequent treatment processes such as the annealing and the aging treatment, are combined such that the mechanical properties of the material can vary in a large range, in order to satisfy the demands of different members.

The magnesium alloy of the present invention has simple chemical compositions without noble alloy elements therein, thereby having a wide applicability and a low manufacturing cost.

The magnesium alloy sheet of the present invention has a broad prospect and potential of applying onto the fields of automobiles, rail transits, 3C, etc, and can act as the sheets of interior door panels of cars, inner panels of engine lids, inner panels of trunk lids, internal decorative panels, vehicle bodies in the rail transits, and housings of 3C products, or the like.

DETAILED DESCRIPTION

Hereinafter the technical solution of the present invention will be further set out in detail in conjunction with the detailed embodiments.

Embodiment 1

The chemical compositions of the Mg—Ca—Zn—Zr magnesium sheet are shown as Table 1. The method of producing the same is:

heating the casting blank of magnesium alloy (the microstructure thereof shown as FIG. 1) with the composition proportions required as Table 1, up to 500° C., and carrying out solid solution with a heat preservation time of 0.5 min/mm, then rolling to obtain the Mg—Ca—Zn—Zr magnesium alloy of this embodiment. When in the hot rolling, the roller surfaces are preheated up to 150° C., the blooming temperature is 450° C., the finish rolling temperature is 350° C., and the reduction rate in a single pass is 20~30%; when in the warm rolling, the roller surfaces are preheated up to 150° C., the magnesium alloy sheet is online concurrent heated, the rolling temperature is 220° C., and the reduction rate in a single pass is 20~40%; when in the cold rolling, the reduction rate is 10%, and the final thickness of the sheet is 0.4 mm.

Figure 1:
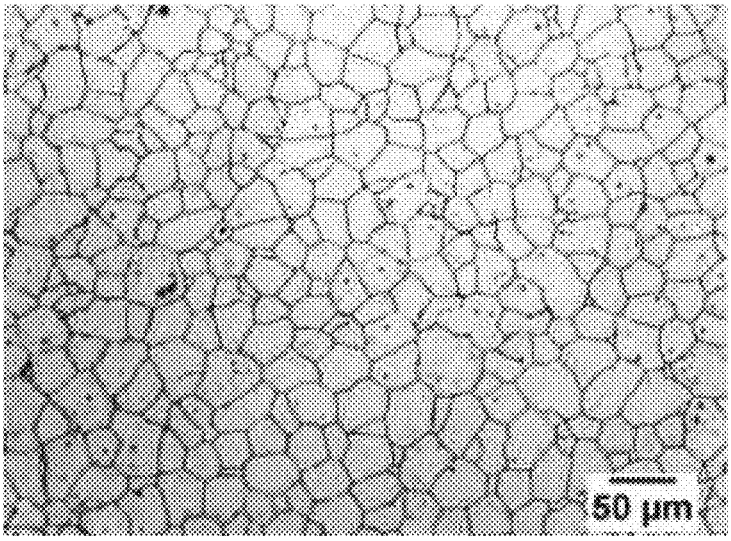
FIG. 1 is a view showing the microstructure of the casting ingot of the Mg—Ca—Zn—Zr magnesium alloy according to Embodiment 1 of the present invention.

The microstructure of the casting ingot of the magnesium alloy according to Embodiment 1 is shown as FIG. 1, which microstructure is the isometric crystals with an average grain size of about 50 μm.

Figure 2:
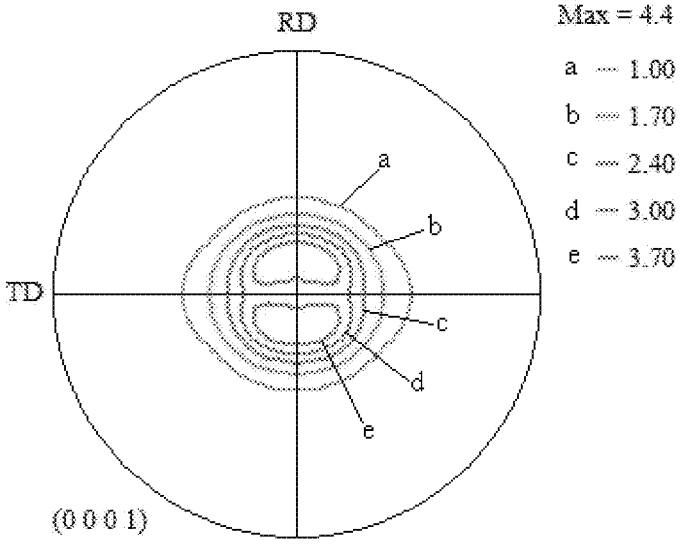
FIG. 2 is a view showing the texture distribution of the Mg—Ca—Zn—Zr magnesium sheet according to Embodiment 1 of the present invention.

The texture distribution of the Mg—Ca—Zn—Zr magnesium alloy sheet according to Embodiment 1 is shown as FIG. 2, with the strength of the texture being 4.4 and the average grain size thereof being 3.85 μm.

Embodiment 2: (Contrastive Example 1)

The composition of the magnesium alloy of Contrastive Example 1: AZ31B.

Manufacturing method: identical to that of Embodiment 1.

Figure 3:
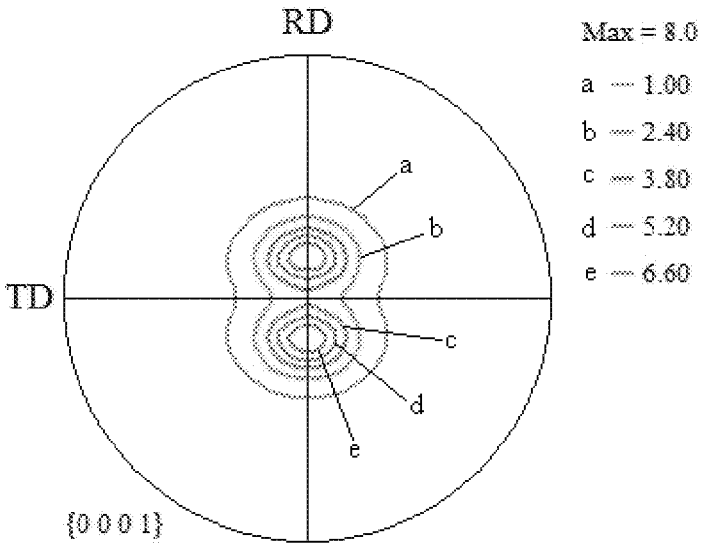
FIG. 3 is a view showing the texture distribution of AZ31 magnesium sheet according to Embodiment 2 of the present invention.

The texture distribution of the AZ31B magnesium alloy sheet according to Contrastive Example 1 is shown as FIG. 3, with the strength of the texture being 8.

Embodiment 3

The chemical compositions of the Mg—Ca—Zn—Zr magnesium sheet are shown as Table 1. The method of producing the same is:

heating the casting blank of magnesium alloy with the composition proportions required as Table 1, up to 500° C., and carrying out solid solution with a heat preservation time of 0.5 min/mm; when in the hot rolling, the roller surfaces are preheated up to 150° C., the blooming temperature is 450° C., the finish rolling temperature is 350° C., and the reduction rate in a single pass is 20~30%; when in the warm rolling, the roller surfaces are preheated up to 150° C., the magnesium alloy sheet is online concurrent heated, the rolling temperature is 220° C., and the reduction rate in a single pass is 20~40%; when in the cold rolling, the reduction rate is 10%, and the final thickness of the sheet is 0.4 mm; annealing at 375° C. for 17 min.

Figure 4:
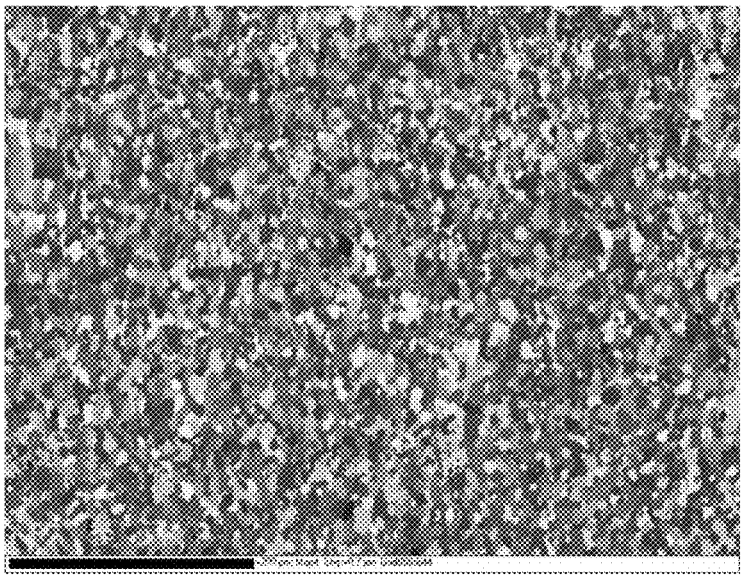
FIG. 4 is a view showing the microstructure of the Mg—Ca—Zn—Zr magnesium sheet after annealing according to Embodiment 3 of the present invention.
Figure 5:
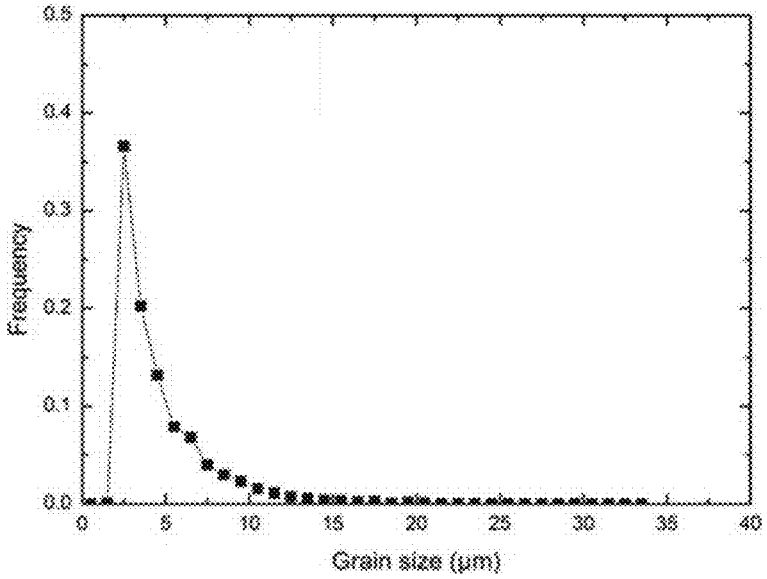
FIG. 5 is a view showing the grain distribution of the annealed Mg—Ca—Zn—Zr magnesium sheet according to Embodiment 3 of the present invention.
Figure 6:
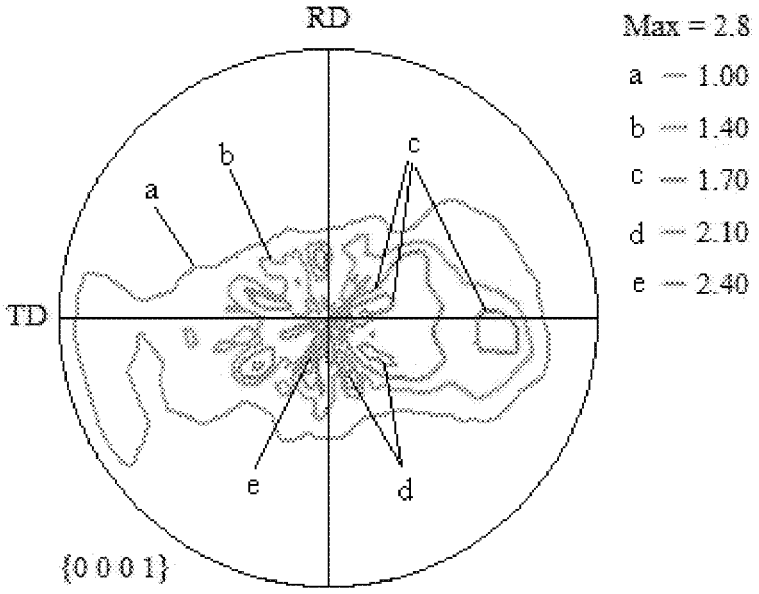
FIG. 6 is a view showing the texture distribution of the annealed Mg—Ca—Zn—Zr magnesium sheet according to Embodiment 3 of the present invention.
Figure 10:
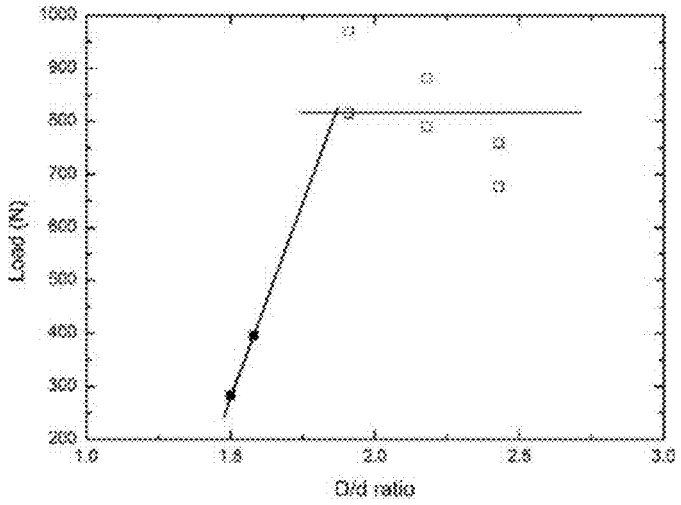
FIG. 10 is a view showing the limit drawing ratio at room temperature of the annealed Mg—Ca—Zn—Zr magnesium sheet according to Embodiment 3 of the present invention.

The microstructure of the casting ingot of the Mg—Ca—Zn—Zr magnesium alloy according to Embodiment 3 is shown as FIG. 4; the grain size distribution thereof is shown as FIG. 5, wherein the average grain size is about 4.62 μm; the texture distribution thereof is shown as FIG. 6, wherein the texture strength is 2.8, and the distribution is of dispersal. The test of formability is shown as FIG. 10, wherein the limit drawing ratio (LDR) is 1.88.

Embodiment 4: (Contrastive Example 2)

The composition of the magnesium alloy of Contrastive Example 2: AZ31B.

Manufacturing method: identical to that of Embodiment 3.

Figure 7:
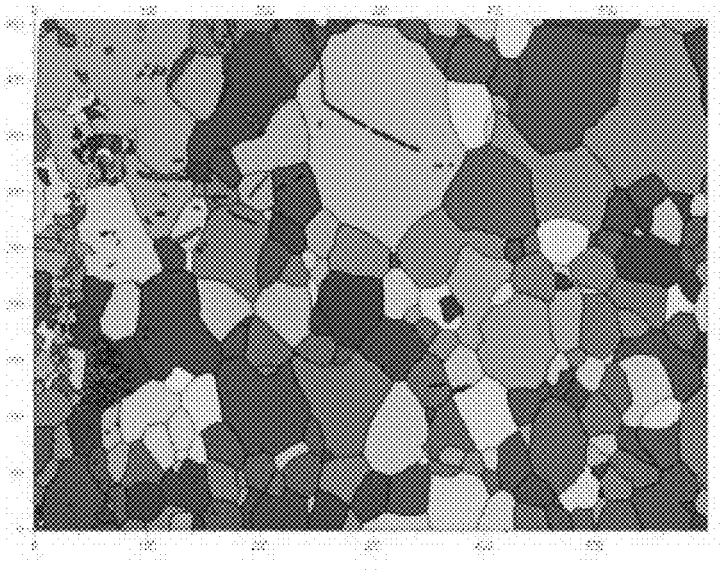
FIG. 7 is a view showing the microstructure of the AZ31 magnesium sheet after annealing according to Embodiment 4 of the present invention.
Figure 8:
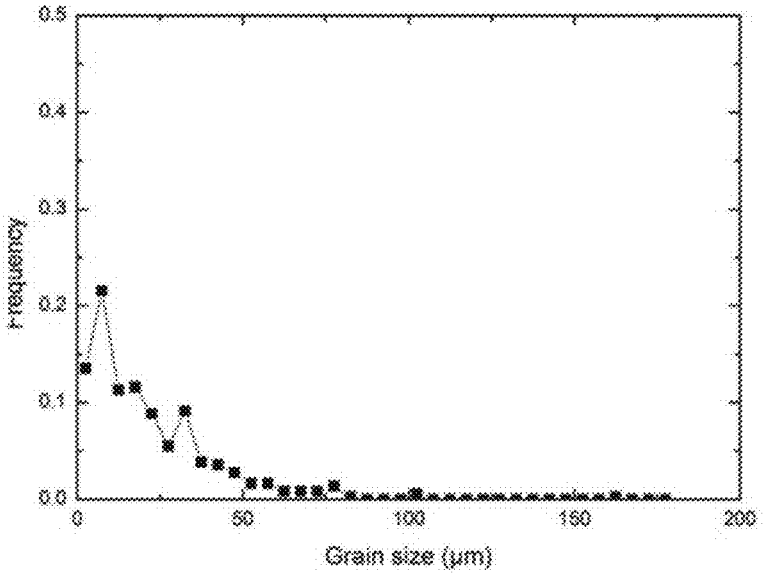
FIG. 8 is a view showing the grain distribution of the annealed AZ31 magnesium sheet.
Figure 9:
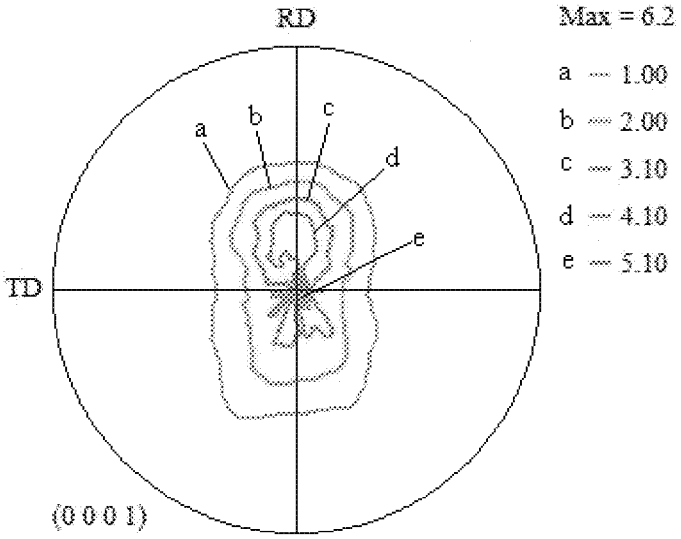
FIG. 9 is a view showing the texture distribution of the annealed AZ31 magnesium sheet according to Embodiment 4 of the present invention.
Figure 11:
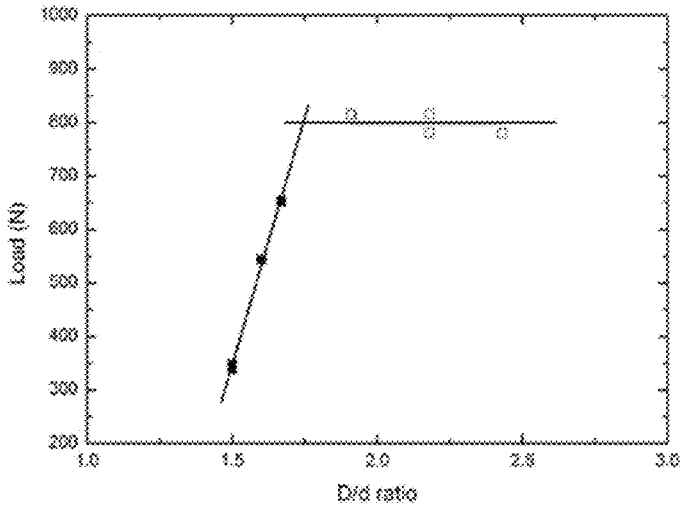
FIG. 11 is a view showing the limit drawing ratio at room temperature of the annealed AZ31 magnesium sheet according to Embodiment 4 of the present invention.

The microstructure of the magnesium alloy AZ31B in Contrastive Example 2 is shown as FIG. 7; the grain size distribution thereof is shown as FIG. 8, wherein the average grain size is about 22 μm; the texture distribution thereof is shown as FIG. 9, wherein the texture strength is 6.2. The test of formability is shown as FIG. 11, wherein the limiting drawing ratio (LDR) is 1.74.

Embodiment 5

The chemical compositions of the Mg—Ca—Zn—Zr magnesium sheet are shown as Table 1. The method of producing the same is:

heating the casting blank of magnesium alloy with the composition proportions required as Table 1, up to 500° C., and carrying out solid solution with a heat preservation time of 0.5 min/mm; when in the hot rolling, the roller surfaces are preheated up to 150° C., the blooming temperature is 450° C., the finish rolling temperature is 350° C., and the reduction rate in a single pass is 20~30%; when in the warm rolling, the roller surfaces are preheated up to 150° C., the magnesium alloy sheet is online concurrent heated, the rolling temperature is 220° C., and the reduction rate in a single pass is 20~40%; when in the cold rolling, the reduction rate is 10%, and the final thickness of the sheet is 0.8 mm; annealing at 375° C. for 35 min.

The Mg—Ca—Zn—Zr magnesium alloy obtained according to this Embodiment has an average grain size of about 5.32 μm, a texture strength of 2.6, a relatively dispersed texture distribution, and a limit drawing ratio (LDR) of 1.86.

Embodiment 6

Figure 12:
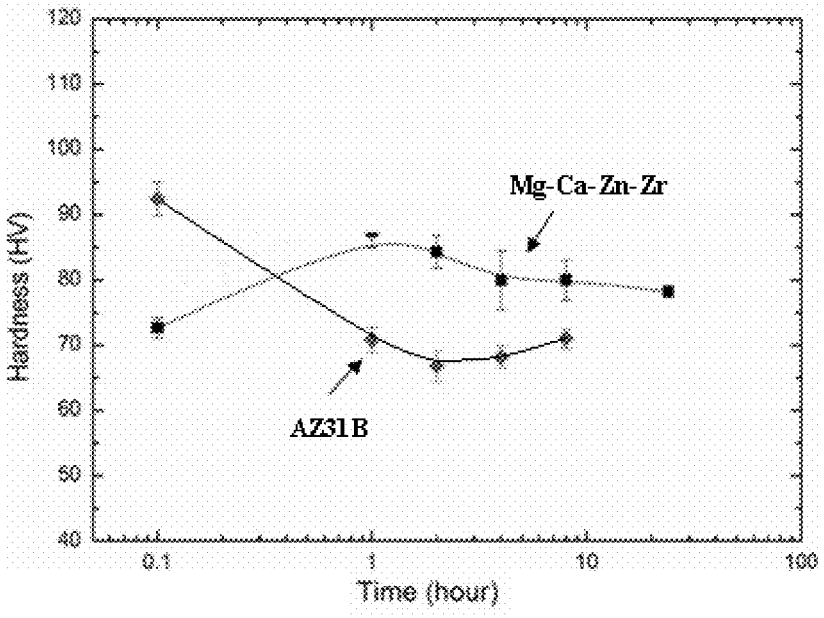
FIG. 12 is a view showing the change on hardness of the Mg—Ca—Zn—Zr magnesium sheet after aging treatment according to Embodiment 6 of the present invention.

The chemical compositions of the Mg—Ca—Zn—Zr magnesium sheet are shown as Table 1. The method of producing the same is:

heating the casting blank of magnesium alloy with the composition proportions required as Table 1, up to 500° C., and carrying out solid solution with a heat preservation time of 0.5 min/mm; when in the hot rolling, the roller surfaces are preheated up to 150° C., the blooming temperature is 450° C., the finish rolling temperature is 350° C., and the reduction rate in a single pass is 20~30%; when in the warm rolling, the roller surfaces are preheated up to 150° C., the magnesium alloy sheet is online concurrent heated, the rolling temperature is 220° C., and the reduction rate in a single pass is 20~40%; when in the cold rolling, the reduction rate is 10%, and the final thickness of the sheet is 0.4 mm; performing the artificial aging treatment at 150° C. The influence of the artificial aging treatment on the hardness of the magnesium alloy is shown in FIG. 12, wherein the hardness of the material rises from HV72 to HV85 after aging treatment for 1 h.

The Mg—Ca—Zn—Zr magnesium alloy obtained according to this Embodiment has an average grain size of about 4.4 μm, a texture strength of 4.0, a relatively dispersed texture distribution, and a limiting drawing ratio (LDR) of 1.79.

Embodiment 7: (Contrastive Example 3)

The composition of the magnesium alloy of Contrastive Example 3: AZ31B.

Manufacturing method: identical to that of Embodiment 6.

The influence of the aging treatment on the hardness of the magnesium alloy is shown in FIG. 12.

Embodiment 8

The chemical compositions of the Mg—Ca—Zn—Zr magnesium sheet are shown as Table 1. The method of producing the same is:

heating the casting blank of magnesium alloy with the composition proportions required as Table 1, up to 500° C., and carrying out solid solution with a heat preservation time of 0.5 min/mm; when in the hot rolling, the roller surfaces are preheated up to 150° C., the blooming temperature is 450° C., the finish rolling temperature is 350° C., and the reduction rate in a single pass is 20~40%; when in the warm rolling, the roller surfaces is preheated up to 200° C., the magnesium alloy sheet is online concurrent heated, the rolling temperature is 200° C., and the reduction rate in a single pass is 20~40%; when in the cold rolling, the reduction rate is 15%, and the final thickness of the sheet is 0.6 mm.

The Mg—Ca—Zn—Zr magnesium alloy obtained according to this Embodiment has an average grain size of about 5.2 μm, a texture strength of 4.6, and a relatively dispersed texture distribution.

Embodiment 9

The chemical compositions of the Mg—Ca—Zn—Zr magnesium sheet are shown as Table 1. The method of producing the same is:

pouring the magnesium alloy melt with the aforementioned composition proportions into a twin-roller continuous cast-rolling mill with the rotation linear velocity of the rollers being 6 m/min, the roller gap being 4-8 mm, the roller surfaces being lubricated by graphite, the gases $N_2$ and $CO_2$ passing through the smelter and casting system, and $SO_2$ passing through the pouring exit for protection; the temperature of the solid solution being 450° C., and the heat preservation time thereof being 0.51 min/mm; when in the warm rolling, the roller surfaces are preheated up to 180° C., the magnesium alloy sheet is online concurrent heated, the rolling temperature is 180~200° C., and the reduction rate in a single pass is 20~30%; then cold rolling by 15%, and annealing at 400° C. for 2 h.

The Mg—Ca—Zn—Zr magnesium alloy obtained according to this Embodiment has an average grain size of about 8.6 μm, a texture strength of 2.6, a relatively dispersed texture distribution, and a limiting drawing ratio (LDR) of 1.89.

Embodiment 10

The chemical compositions of the Mg—Ca—Zn—Zr magnesium sheet are shown as Table 1. The method of producing the same is:

heating the casting blank of magnesium alloy with the aforementioned composition proportions up to a temperature of 500° C., and carrying out solid solution with a heat preservation time of 0.5 min/mm; then performing horizontal extrusion, with the extrusion container and die (die cushion) being preheated up to 500° C., the extrusion temperature being 350° C., the extrusion rate being 5 m/min, so as to obtain a magnesium alloy sheet with a thickness of 4 mm; adopting the warm rolling process, with the roller surfaces being preheated up to 150° C., the magnesium alloy sheet being online concurrent heated, the rolling temperature being 150~300° C., and the reduction rate in a single pass being 30~50%; then cold rolling by 20%, and annealing at 400° C. for 30 min.

The Mg—Ca—Zn—Zr magnesium alloy obtained according to this Embodiment has an average grain size of about 8.5 μm, a texture strength of 2.8, a relatively dispersed texture distribution, and a limiting drawing ratio (LDR) of 1.88.

Embodiment 11

The chemical compositions of the Mg—Ca—Zn—Zr magnesium sheet are shown as Table 1. The method of producing the same is identical to that of Embodiment 8.

The Mg—Ca—Zn—Zr magnesium alloy obtained according to this Embodiment has an average grain size of about 5.4 μm, a texture strength of 4.6, and a relatively dispersed texture distribution.

Embodiment 12

The chemical compositions of the Mg—Ca—Zn—Zr magnesium sheet are shown as Table 1. The method of producing the same is identical to that of Embodiment 9.

The Mg—Ca—Zn—Zr magnesium alloy obtained according to this Embodiment as an average grain size of about 6.8 μm, a texture strength of 2.8, a relatively dispersed texture distribution and a limiting drawing ratio (LDR) of 1.85.

Embodiment 13

The method of producing the Mg—Ca—Zn—Zr magnesium sheet is:

pouring the magnesium alloy melt with the composition proportions of Embodiment 9 into a twin-roller continuous cast-rolling mill, with the rotation linear velocity of the rollers being 6 m/min, the roller gap being 4 mm, the roller surfaces being lubricated by graphite, the gases $N_2$ and $CO_2$ passing through the smelter and casting system, and $SO_2$ passing through the pouring exit for protection; subsequently warm rolling directly, and when in the warm rolling, the roller surfaces are preheated up to 180° C., the magnesium alloy sheet is online concurrent heated, the rolling temperature is 180~200° C., and the reduction rate in a single pass is 20~30%; then cold rolling by 15%, and annealing at 400° C. for 2 h.

The Mg—Ca—Zn—Zr magnesium alloy obtained according to this Embodiment has an average grain size of about 8.9 μm, a texture strength of 2.9, a relatively dispersed texture distribution, and a limiting drawing ratio (LDR) of 1.82.

Embodiment 14

The method of producing the Mg—Ca—Zn—Zr magnesium sheet is:

heating the casting blank of magnesium alloy with the aforementioned composition proportions up to a temperature of 500° C., and carrying out solid solution with a heat preservation time of 0.5 min/mm; then performing horizontal extrusion, with the extrusion container and die (die cushion) being preheated up to 500° C., the extrusion temperature being 350° C., the extrusion rate being 5 m/min, so as to obtain a magnesium alloy sheet with a thickness of 4 mm; then cold rolling by 20%, and annealing at 400° C. for 30 min.

The Mg—Ca—Zn—Zr magnesium alloy obtained according to this Embodiment has an average grain size of about 5.9 μm, a texture strength of 2.8, a relatively dispersed texture distribution, and a limiting drawing ratio (LDR) of 1.88.

Embodiment 15

The method of producing the Mg—Ca—Zn—Zr magnesium sheet is:

heating the casting blank of magnesium alloy (the microstructure thereof shown as FIG. 1) with the composition proportions required as Table 1, up to 500° C., and carrying out solid solution with a heat preservation time of 0.5 min/mm, then rolling to obtain the Mg—Ca—Zn—Zr magnesium alloy of this embodiment. When in the hot rolling, the roller surfaces are preheated up to 150° C., the blooming temperature is 450° C., the finish rolling temperature is 350° C., and the reduction rate in a single pass is 20~30%; when in the warm rolling, the roller surfaces are preheated up to 150° C., the magnesium alloy sheet is online concurrent heated, the rolling temperature is 220° C., and the reduction rate in a single pass is 20~40%; and the obtained magnesium alloy sheet has a thickness of 0.44 mm, and is subjected to annealing at 300° C. for 30 min.

The Mg—Ca—Zn—Zr magnesium alloy obtained according to this Embodiment has an average grain size of about 4.2 μm, a texture strength of 2.6, a relatively dispersed texture distribution, and a limit drawing ratio (LDR) of 1.92.

TABLE 1 unit: wt %

| | Ca | Zn | Zr | Mg/Impurities |
|---|---|---|---|---|
| Embodiment 1 | 0.72 | 0.43 | 0.83 | Remainders |
| Embodiment 3 | 0.72 | 0.43 | 0.83 | Remainders |
| Embodiment 5 | 0.72 | 0.43 | 0.83 | Remainders |
| Embodiment 6 | 0.72 | 0.43 | 0.83 | Remainders |
| Embodiment 8 | 0.60 | 0.96 | 0.75 | Remainders |
| Embodiment 9 | 0.65 | 0.90 | 0.65 | Remainders |
| Embodiment 10 | 0.79 | 0.82 | 0.56 | Remainders |
| Embodiment 11 | 0.95 | 0.60 | 0.75 | Remainders |
| Embodiment 12 | 0.50 | 0.75 | 0.95 | Remainders |

What is claimed is:

1. A Mg—Ca—Zn—Zr magnesium alloy sheet, having the chemical compositions in weight percentage: Ca: 0.5~1.0%, Zn: 0.4~1.0%, Zr: 0.5~1.0%, the remainders being Mg and unavoidable impurities; wherein the magnesium alloy sheet has an average grain size of less than or equal to 10 μm, an interarea texture strength of less than or equal to 5, an interarea texture strength after annealing at 250~400° C. of less than or equal to 3, and a limiting drawing ratio at room temperature of more than 1.74; and the magnesium alloy sheet has a thickness of 0.3~4 mm.

2. A method of producing the Mg—Ca—Zn—Zr magnesium alloy sheet according to claim 1, which is any one of the following methods (1)~(3):

(1) heating the casting blank of Mg—Ca—Zn—Zr magnesium alloy with the aforementioned composition proportions up to a temperature of 370~500° C., and carrying out solid solution, then hot rolling and warm rolling, so as to obtain the Mg—Ca—Zn—Zr magnesium alloy sheet with a thickness of 0.3~4 mm; wherein the heat preservation time in the solid solution is 0.5~1 min/mm;

when in the hot rolling, the roller surfaces are preheated at 150~350° C., the blooming temperature is 450~500° C., the finish rolling temperature is 300~350° C., and the reduction rate in a single pass is 20~50%;

when in the warm rolling, the roller surfaces are preheated up to 150~350° C., the magnesium alloy sheet is online concurrent heated, the rolling temperature is 150~350° C., and the reduction rate in a single pass is 20~40%;

(2) pouring the magnesium alloy melt with the aforementioned composition proportions into a twin-roller continuous cast-rolling mill for cast-rolling, so as to obtain the cast-rolling coil; carrying out solid solution and warm rolling, or warm rolling directly, so as to obtain the Mg—Ca—Zn—Zr magnesium alloy sheet with a thickness of 0.3~4 mm;

wherein in the cast-rolling process by the twin-roller continuous cast-rolling mill, the rotation linear velocity of the rollers is 5-10 m/min, the roller gap is 4-8 mm, the roller surfaces are lubricated by graphite, and the gases $N_2$ and $CO_2$ pass through the smelter and casting system and $SO_2$ passes through the pouring exit for protection;

the temperature of the solid solution is 370~500° C., and the heat preservation time thereof is 0.5~1 min/mm;

when in the warm rolling, the roller surfaces are preheated up to 180~300° C., the magnesium alloy sheet is online concurrent heated, the rolling temperature is 180~300° C., and the reduction rate in a single pass is 20~40%;

(3) heating the casting blank of magnesium alloy with the aforementioned composition proportions up to a temperature of 370~500° C., and carrying out solid solution, then performing horizontal extrusion, so as to obtain the Mg—Ca—Zn—Zr magnesium alloy sheet with a thickness of 2~4 mm, or performing horizontal extrusion and subsequently warm rolling, so as to obtain the Mg—Ca—Zn—Zr magnesium alloy sheet with a thickness of 0.3~2 mm;

wherein the heat preservation time in the solid solution is 0.5~1 min/mm;

when in the horizontal extrusion, the extrusion container and die are preheated up to 400~500° C., the extrusion temperature is 350~500° C., and the extrusion rate is 2~10 m/min; and when in the warm rolling, the roller surfaces are preheated up to 150~300° C., the magnesium alloy sheet is online concurrent heated, the rolling temperature is 150~300° C., and the reduction rate in a single pass is 30~50%.

3. The method of producing Mg—Ca—Zn—Zr magnesium alloy sheet according to claim 2, wherein it further comprises a cold rolling stage, wherein the cold rolling reduction rate is 10~20%, and the thickness of the finished sheet is about 0.3 mm.

4. The method of producing Mg—Ca—Zn—Zr magnesium alloy sheet according to claim 2, wherein it further comprises an annealing treatment and/or an aging treatment; wherein the annealing temperature is 250~400° C., and the aging temperature is 150~200° C.

5. The method of producing Mg—Ca—Zn—Zr magnesium alloy sheet according to claim 3, wherein it further comprises an annealing treatment and/or an aging treatment; wherein the annealing temperature is 250~400° C., and the aging temperature is 150~200° C.

* * * * *